US006402584B1

(12) United States Patent
Dear

(10) Patent No.: US 6,402,584 B1
(45) Date of Patent: Jun. 11, 2002

(54) FLAPPING HEART AMUSEMENT DEVICE

(76) Inventor: David Dear, 283 Ave. C. Apt. 7H, New York, NY (US) 10009

( * ) Notice: Subject to any disclaimer, the term of this patent is extended or adjusted under 35 U.S.C. 154(b) by 0 days.

(21) Appl. No.: 09/578,081

(22) Filed: May 24, 2000

(51) Int. Cl.[7] ..... A63H 33/00

(52) U.S. Cl. ..... 446/487; 446/486

(58) Field of Search ..... 446/129, 130, 446/295, 376, 486, 487, 397

(56) References Cited

U.S. PATENT DOCUMENTS

| | | | |
|---|---|---|---|
| D268,400 | S | 3/1983 | Wagman |
| 4,592,936 | A | 6/1986 | Ferguson |
| 4,729,748 | A | 3/1988 | Van Ruymbeke |
| 4,737,131 | A | 4/1988 | Sirota |
| 5,032,101 | A | 7/1991 | Hartman |
| 5,310,375 | A | 5/1994 | Kanauchi |
| 5,390,510 | A | 2/1995 | Tirio-Cloonan |
| 5,417,833 | A | 5/1995 | Harra |
| 5,525,090 | A | 6/1996 | Halford |
| D374,194 | S | 10/1996 | Brocchi |

*Primary Examiner*—John A. Ricci
*Assistant Examiner*—Alex F. R. P. Rada, II

(57) ABSTRACT

A flapping heart amusement device comprises a left side, a right side, and a central support member. The left side and right side are symmetrical in nature and represent each half of a heart shape. An interior edge of each side meet at the central support member, which is cylindrical and vertical in orientation. A vertically aligned hinge pin runs through the central support member through openings therewithin, the hinge pin allowing the left side and the right side to swivel therefrom. A housing encapsulates a power means and is located at a position behind the left side and right side. A left linkage means extends outwardly from the power means located within the housing and engages the left side, a first end of the left linkage rigidly affixed to a double-ended crank shaft located within the housing and positioned perpendicularly thereto, with a distal end of left linkage means rigidly attached to the left side of the heart. Similarly, a right linkage means extendes outwardly from the power and engages the right side of heart, a first end of the right linkage means rigidly affixed to the double-ended crank shaft, a distal end of the right linkage means rigidly attached to the right side of heart. In total, engagement of the power means functions to rotate the crankshaft along the horizontal axis, functioning to engage the left linkage means and right linkage means, and functioning to drive the two sides of the heart forwardly and rearwardly to create a flapping effect.

15 Claims, 7 Drawing Sheets

FLAPPING HEART AMUSEMENT DEVICE

BACKGROUND OF THE INVENTION

1. Field of the Invention

The present invention is a powered amusement device, which, in the preferred mode, consists of a plastic, heart-shaped apparatus. Arms extend from a gearbox within the power means affixed to the back of the device. The arms are rigidly attached to the left side and the right side of the heart, and the sides are hingedly linked at the center of the heart. Engagement of the power means causes the two sides to swing backward and forward along the vertical plane, resulting in a "flapping" effect. In the preferred mode, the device operates with the aid of a miniature wind-up motor. In an alternate mode, a pull-cord may be utilized to power the device. Accordingly, the present invention can be used as an amusement device in the form of a pin, a magnet, or a table top novelty item.

2. Description of the Prior Art

Many relevant innovations amusement devices are provided in the prior art, described as follows. Although these inventions are suitable for the purposes they address, they differ from the present invention as contrasted herein. Following is a summary of patents most relevant to the invention at hand, including description of differences between features of the invention and those of the prior art.

1. U.S. Pat. No. 4,737,131, invented by Sirota entitled "Toy"

The patent to Sirota describes a toy, in which an image of an expanding and contracting heart is produced by a separate generator, or in response to sensing a pulse beat of a child by a sensor or in response to sensing at least one parameter of environment by environment sensors 2. U.S. Pat. No. Des. 374,194, invented by Brocchi, entitled "Heart Shaped Pendant"

The design patent to Brocchi is an ornamental design for a heart-shaped pendant, as shown herein.

3. U.S. Pat. No. 4,729,748; invented by Van Ruymbeke, entitled "Flying Toy"

The patent to Van Ruymbeke describes a flying toy which can move through the air by flapping its wings and consists of a body having at least one opening, at least one flexible wing connected to the body which can flap to move the flying toy through the air, and an elastic band for storing power for flapping the at least one flexible wing. The toy also includes an activation assembly connected to the elastic band for activating the flapping of the at least one flexible wing by the elastic band. The at least one oscillating wing base is secured to the at least one flexible wing through the at least one opening. The toy also includes a wind-up assembly for winding the elastic band and a latching assembly for neutralizing the activation assembly before the flying toy is released to fly. The latching assembly is constructed and arranged such that activation of the flying toy to cause flight can be accomplished using only one hand.

4. U.S. Pat. No. Des. 268,400, invented by Wagman, entitled "Rotating Heart Shaped Plaque"

The design patent to Wagman is an ornamental design for a rotating heart-shaped plaque, shown herein.

5. U.S. Pat. No. 5,417,833, invented by Harra et al., entitled "Sputtering Apparatus Having A Rotating Magnet Array And Fixed Electromagnets"

In the patent to Harra et al., a magnetron sputter apparatus is disclosed which includes a rotatable generally heart-shaped, closed-loop magnet array behind the target and in front of a pair of separately driven stationary electromagnets. The apparatus is optimized to produce a sputtered film on a planar substrate having desired film characteristics such as uniformity of thickness, good step coverage, and good via filling and efficient utilization of the target. The shape of the generally heart-shaped array includes a flattened tip forming an arc of a circle centered on the axis of rotation and concave cusps in the lobes of the heart-shape. The electromagnets are used to increase target utilization at its center and to compensate for the change in shape of the target and distance from the target to the substrate with depletion.

6. U.S. Pat. No. 5,032,101, invented Hartman, entitled "Spinning Toy"

The patent to Hartman describes an improved spinning toy comprised of a primary flywheel affixed near one end of a shaft penetrating the central axis, a symmetrical handle having a specific size, shape, and relational location rotatably connected about the shaft penetrating it; a smaller secondary flywheel near the lower end of the handle through which the shaft penetrates, two end caps having conical terminations, flat surfaces on the sides of the handle, a tangential line of the handle having the lower end tip in the line, and a hole in the handle through which a string passes.

7. U.S. Pat. No. Des. 5,310,375, invented by Kanauchi, entitled "Small Decoration Equipped With Spring-Operated Movable Decorative Element"

The patent to Kanauchi describes a small decoration capable of exhibiting play characteristics sufficient to provide a key ring with unexpectedness. The small decoration includes a container provided with a key ring mounting section. In the container is arranged a spring drive unit including a drive mechanism which includes a plurality of gears driven by a spiral spring. The drive mechanism also includes two gear shafts arranged so as to vertically project from the spring drive unit. One of the gear shafts is mounted with a decorative element such as a doll and the other gear shaft is mounted with a spring winding-up clement. The spring winding-up element is adapted to wind up the spiral spring in association with closing of a lid member pivotally connected to the container and be returned to the original state while unwinding the spiral spring to actuate the decorative element when the lid member is open.

8. U.S. Pat. No. 5,525,090, invented by Halford et al. entitled "Toy Vehicle Having Pivoting Pincers"

The patent to Halford describes a toy vehicle which includes a body supporting a pair of rear wheels and a pivotally secured lower jaw portion supporting a pair of front wheels. The vehicle further includes a pair of pivotally secured pincers movable between a rearward or closed position and a forwardly extending or open position. Each pincer is coupled to a gear portion which in turn is coupled to one side of a two-sided gear rack movable within the vehicle body in response to a pivoting actuator. As the actuator is pivoted, the gear rack is driven forwardly or rearwardly to cause pivotal motion of the pincers. A resilient body is secured to the vehicle body and includes a plurality of flexible tubular tentacles which extend from the resilient body and are coupled to each of the pincers. As a result, the toy is configured in a standard appearance closed position or a monster-like configuration as the actuator is moved between alternative positions.

9. U.S. Pat. No. 4,592,936, invented by Ferguson, entitled "Ornamental Article With Internal Display Bracket"

The Ferguson invention relates to a decorative ornamental object suitable for use as a Christmas ornament. Valentine heart, Easter egg or other holiday or occasion-related article. The ornamental object comprises a hollow housing having an aperture for viewing the inside of the housing. The present invention provides for mounting a picture, personalized message, and other two- and three-dimensional elements inside the housing which may be viewed through the viewing aperture. These display elements may be easily placed in or removed from the ornamental object. In addition, the ornamental object may be used as a gift container.

10. U.S. Pat. No. 5,390,510, invented by Tirio-Cloonan, entitled "Pendent Having Compact And Decorative Scent Receptacle"

The patent to Tirio-Cloonan describes a pendent, having a generally heart-shaped housing with an interior cavity formed therein and an internal heart-shaped aperture at its center. A planar support base is formed at the lower portion of the heart-shaped housing while an upwardly extending cylindrical neck portion is formed in the upper portion of the heart-shaped housing. A cap includes a cylindrical stopper receivable within the housing neck to provide closure of the interior cavity thereof The heart-shaped housing interior cavity is divided by an interior wall into a closed sealed cavity portion which receives and supports a liquid and glitter particle combination. The remaining portion of the housing interior cavity is accessible through the neck portion to provide a refillable reservoir for liquids such as colognes perfume or the like. A heart-shaped compact having mating half portions is receivable within the heart-shaped interior aperture of the housing and is securable to the pendent by a tight fit therebetween. A ring includes a generally U-shaped resilient clasp receivable upon the neck portion of the pendent and bearing an ornamental article to further enhance the appearance of the pendent.

The above-listed patents relating to heart-shaped novelty items and wind-Lip toys largely entail features such as: Static, non-moving heart-shaped ornaments; toys with flapping wings, such as spinning or flying toys; and pulsing or throbbing heart devices within children's dolls or figures.

In contrast to the above, the present invention is a powered heart-shaped apparatus utilizing hingedly linked left and right sides, a preferred wind-up gear box, and linkage arms from the gear box to the sides. Engagement of the power means causes the sides to swing backward and forward, or "flap" back and forth. As such, the invention provides an amusing device to be used as a pin, magnet, or a table-top novelty item.

SUMMARY OF THE INVENTION

As noted, the present invention is an amusement device which consists of a plastic, heart-shaped apparatus. Arms extend from a gearbox within a power means affixed to the back of the device and are attached to the left and right sides of the heart, such sides hingedly linked at the center of the heart. The power means causes the sides to swing backward and forward, resulting in a "flapping" effect.

According to the foregoing, it is an object of the present invention to provide an entertaining device which may be used as a pin, table-top item, or magnet.

It is also a goal of the invention to provide an amusement device that functions effectively without the usage of complex or expensive power means.

For instance, it is a goal of the invention to provide a device which operates with the aid of a simple miniature wind-up motor in the preferred mode.

Further, it is a goal of the invention to provide a device which operates with the aid of a pull-cord in an alternate mode.

It is a goal of the invention to provide an ornamental device which may be manufactured in a variety of sizes.

It is a further goal of the present invention to provide an entertaining device that may bear various colors and patterns or indicia thereon, such indicia relating to a previously determined theme or style.

It is a more particular object of the invention to provide an entertaining device which may be used as a decoration during specific times, such as Valentine's Day.

It is a further goal of the present invention to provide an amusement device that is constructed of a durable, lightweight material.

It is an additional goal of the invention to provide an amusement device that may be enhanced through the addition of an audio means or an illumination means.

Finally, it is an aim of the present invention to provide an entertaining device that may be manufactured with relative ease.

In total, the novel features considered characteristic for the invention are set forth in the claims. The invention itself both as to its construction and method of operation, will be best understood from the following description of the embodiments when read and understood in connection with the drawings provided.

BRIEF DESCRIPTION OF PREFERRED EMBODIMENTS

DETAILED DESCRIPTION OF THE PREFERRED EMBODIMENT

Figure 1:
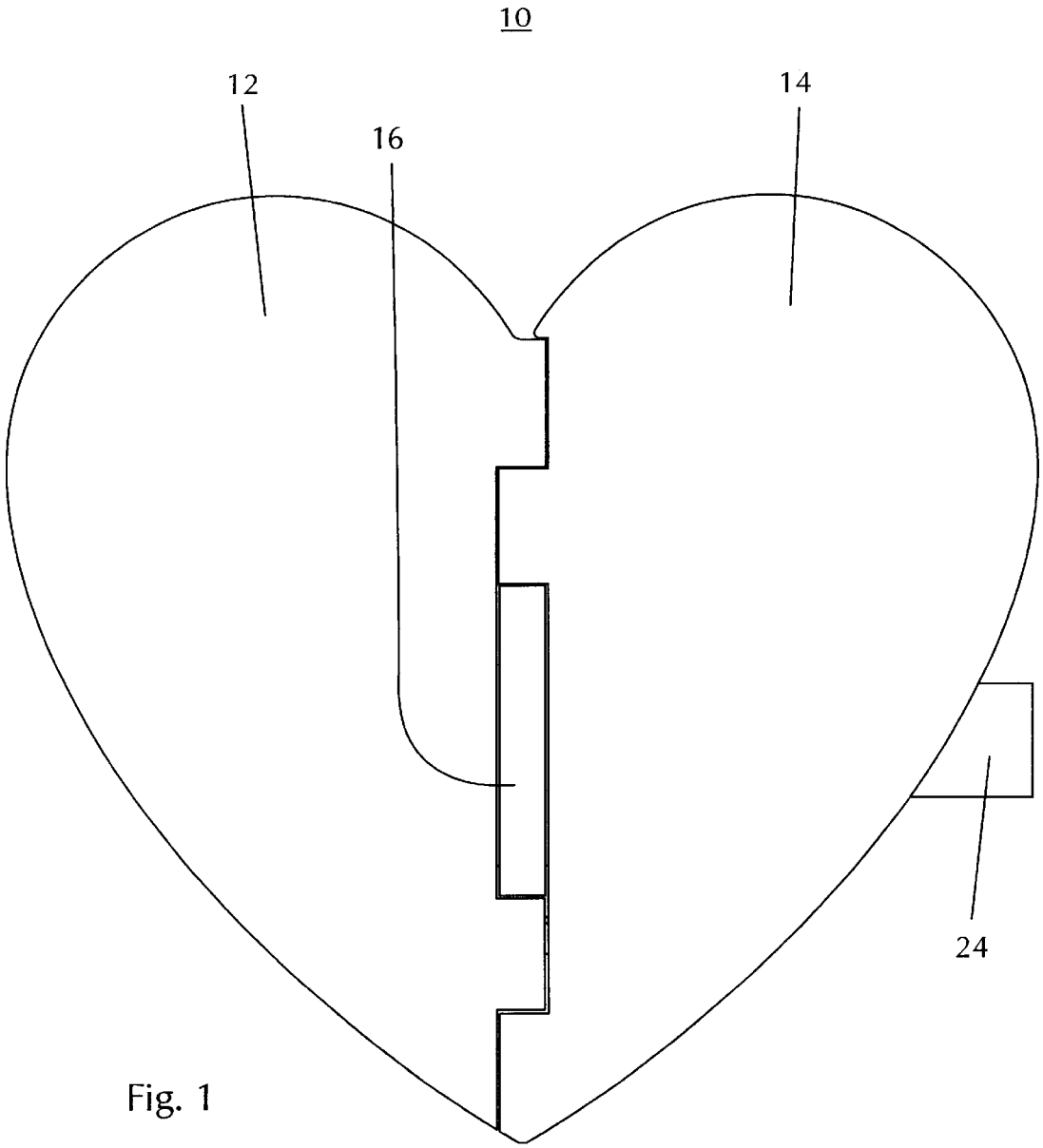
FIG. 1 is a front perspective view of the flapping heart device, illustrating wind-up handle.

FIG. 1 is a front perspective view of the flapping heart device (10). Illustrated are the left side of the heart (12), right side of the heart (14), central support member (16), and wind-up handle (24). Left side of the heart (12) and right side of the heart (14) are symmetrical in nature representing each half of the heart, the interior edge of each meeting at central support member (16), which is cylindrical and vertical in orientation.

Such constitutes the front view of the most basic embodiment of the present invention, whereby the device is manifested in a simple table-top configuration. Alternatively, the device may include a magnet affixed to the rear surface thereof, so as to allow the device to be removably affixed to a refrigerator or other metal surface.

Figure 2:
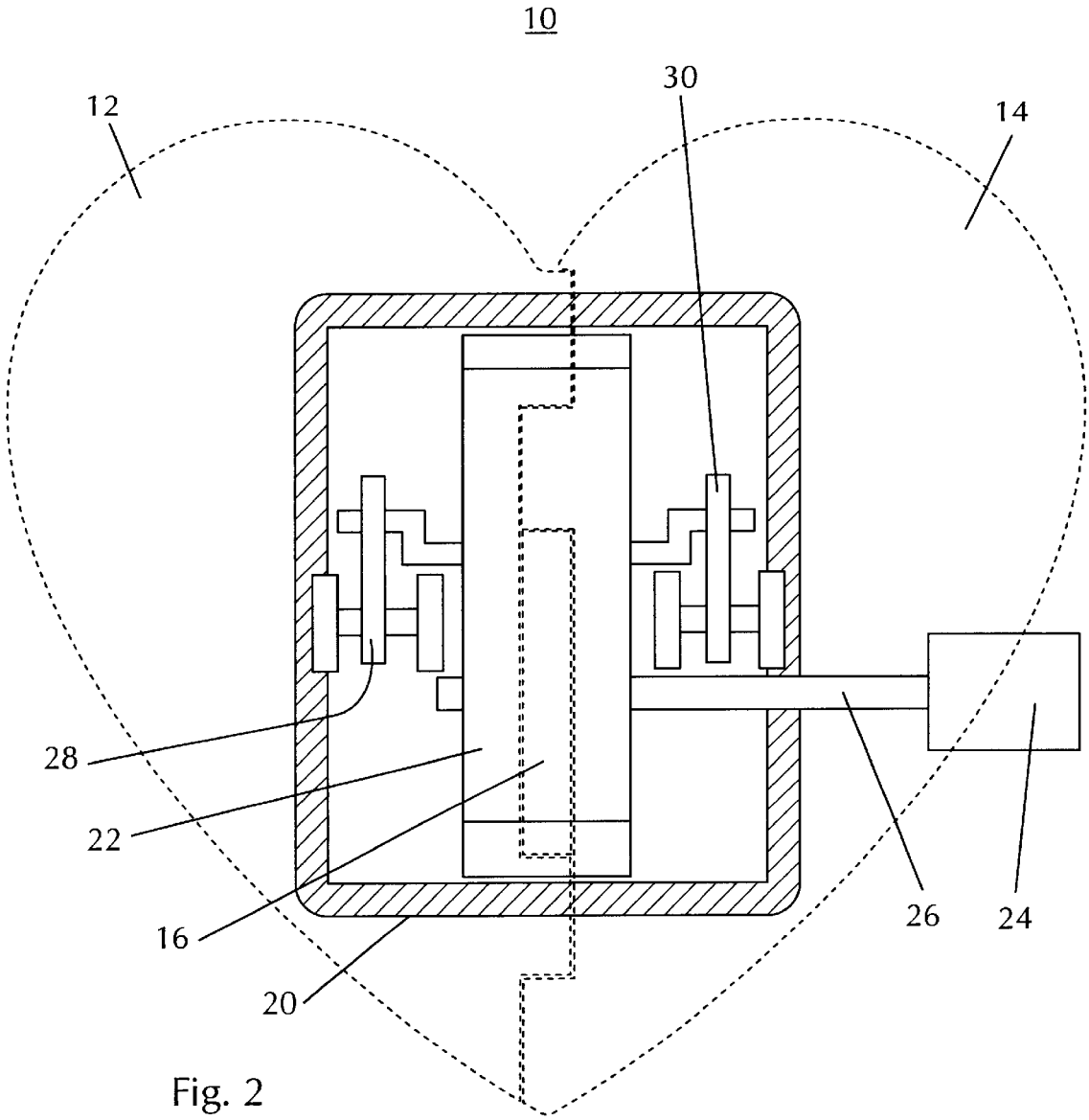
FIG. 2 is a front perspective, partial cut-away view of the flapping heart device, illustrating drive means.

FIG. 2 is a front perspective, partial cut-away view of the flapping heart device, illustrating power or drive means. In this transparent-type view, illustrated are the left side (12), right side (14), central support member (16), housing (20), power means (22), wind-up handle (24), wind-up shaft (26), left linkage means (28), and right linkage means (30).

The housing (20) encapsulates a power means (22), which, in the preferred mode is a traditional wind-up gear box mechanism. As such, the user can conveniently turn wind-up handle (24), thus rotating the wind-up shaft (26) rigidly affixed thereto. Left linkage means (28) emanates from housing (20) to engage left side of heart (12), and right linkage means (30) emanates from housing (20) to engage right side of heart (14) in the opposite direction.

Figure 3:
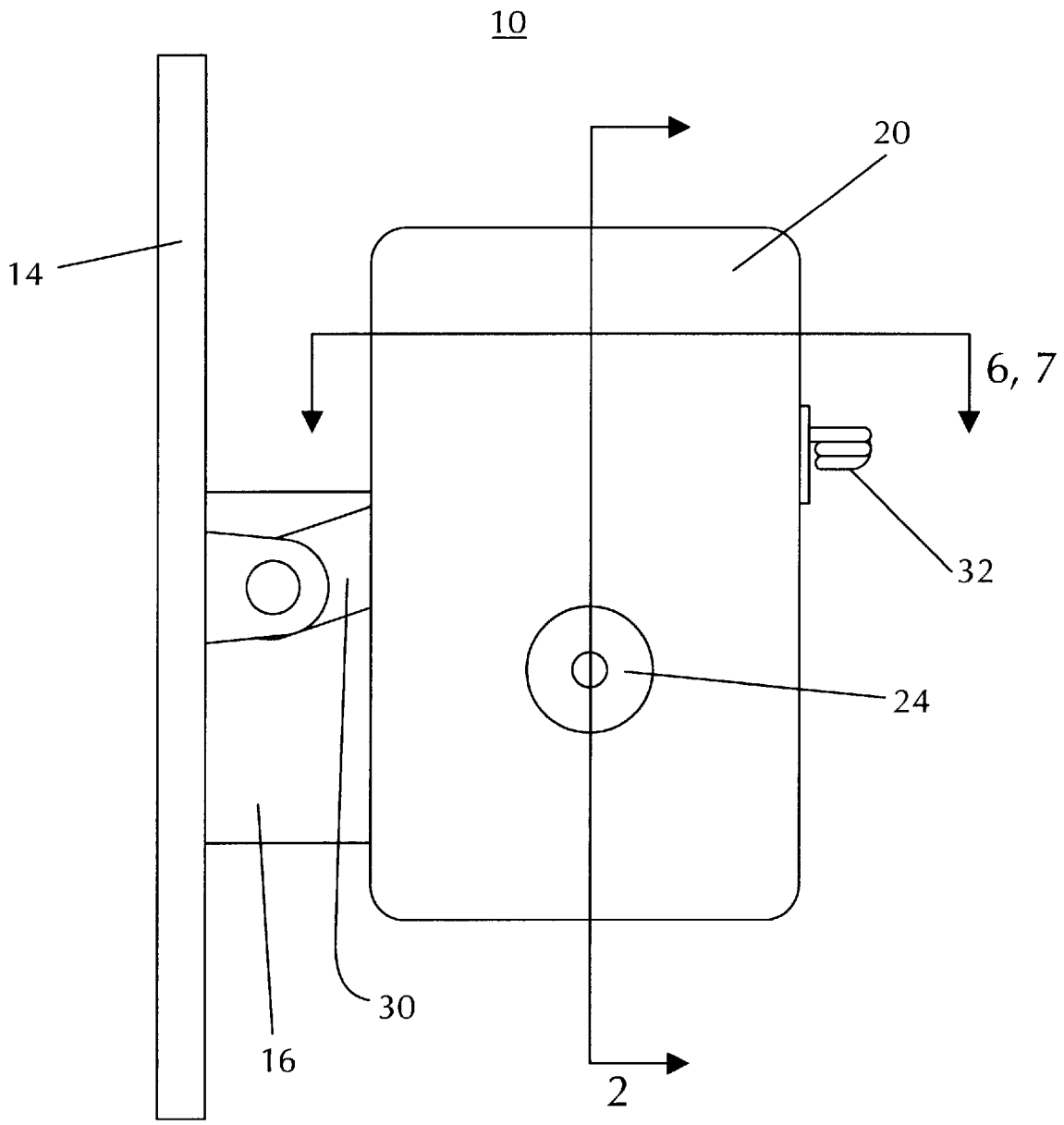
FIG. 3 is a side view of the flapping heart device, illustrating line "2" denoting FIG. 2 view, and line "6" denoting FIG. 6 view.
Figure 6:
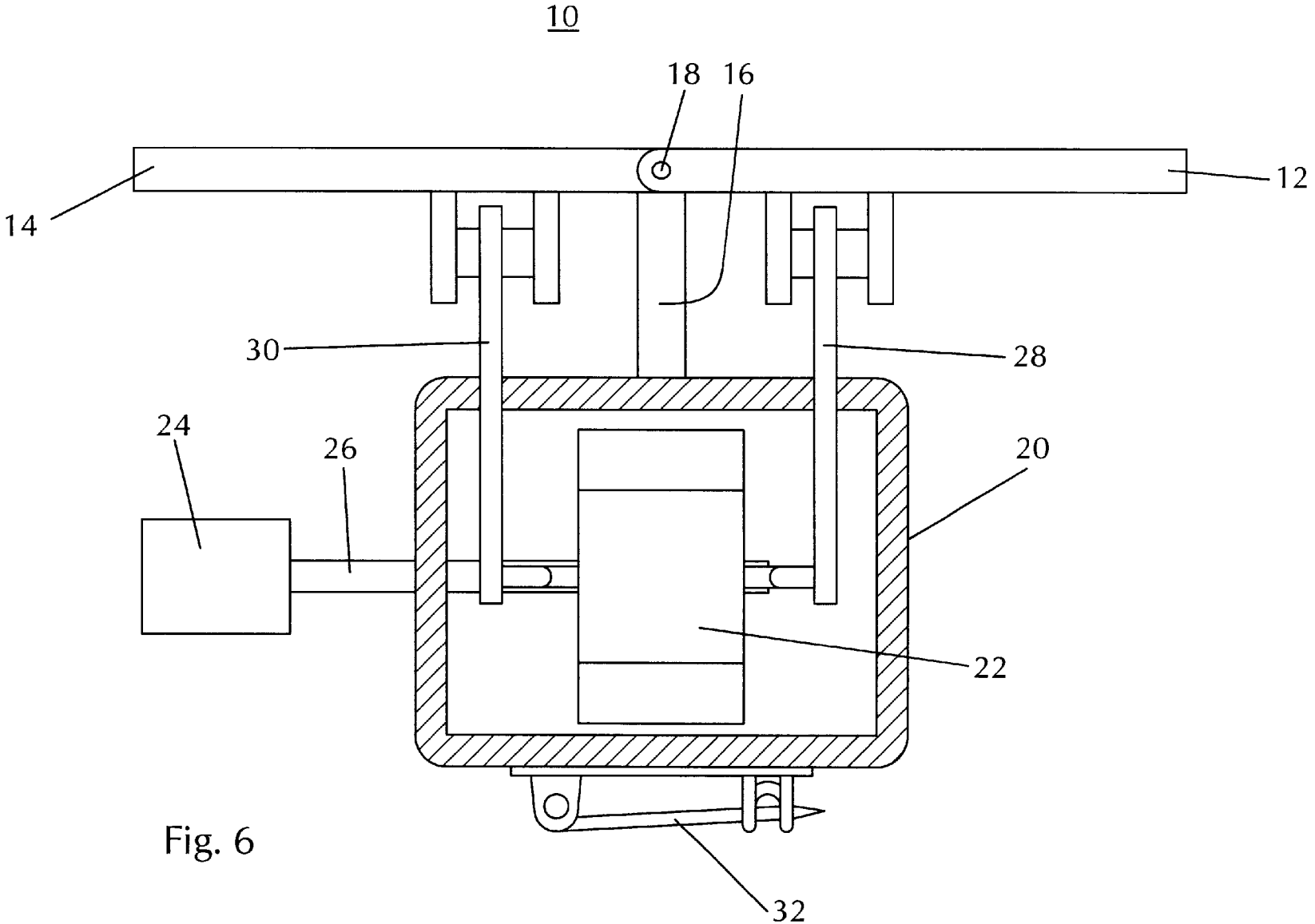
FIG. 6 is a top cut-away view of the flapping heart device, illustrating drive means.

FIG. 3 is a side view of the flapping heart device, illustrating line "2" denoting FIG. 2 view, and line "6" denoting FIG. 6 view. Illustrated are the right side of the heart (14), central support member (16), housing (20), wind-up handle (24), right linkage means (30), and pin assembly (32).

As an alternate embodiment to that previously mentioned, pin assembly (32) (fully depicted in FIGS. 5, 6, AND 7) provides a means to fasten the device to another article, such as a shirt, sweater, jacket, curtain or cloth for decorative purposes.

Figure 4:
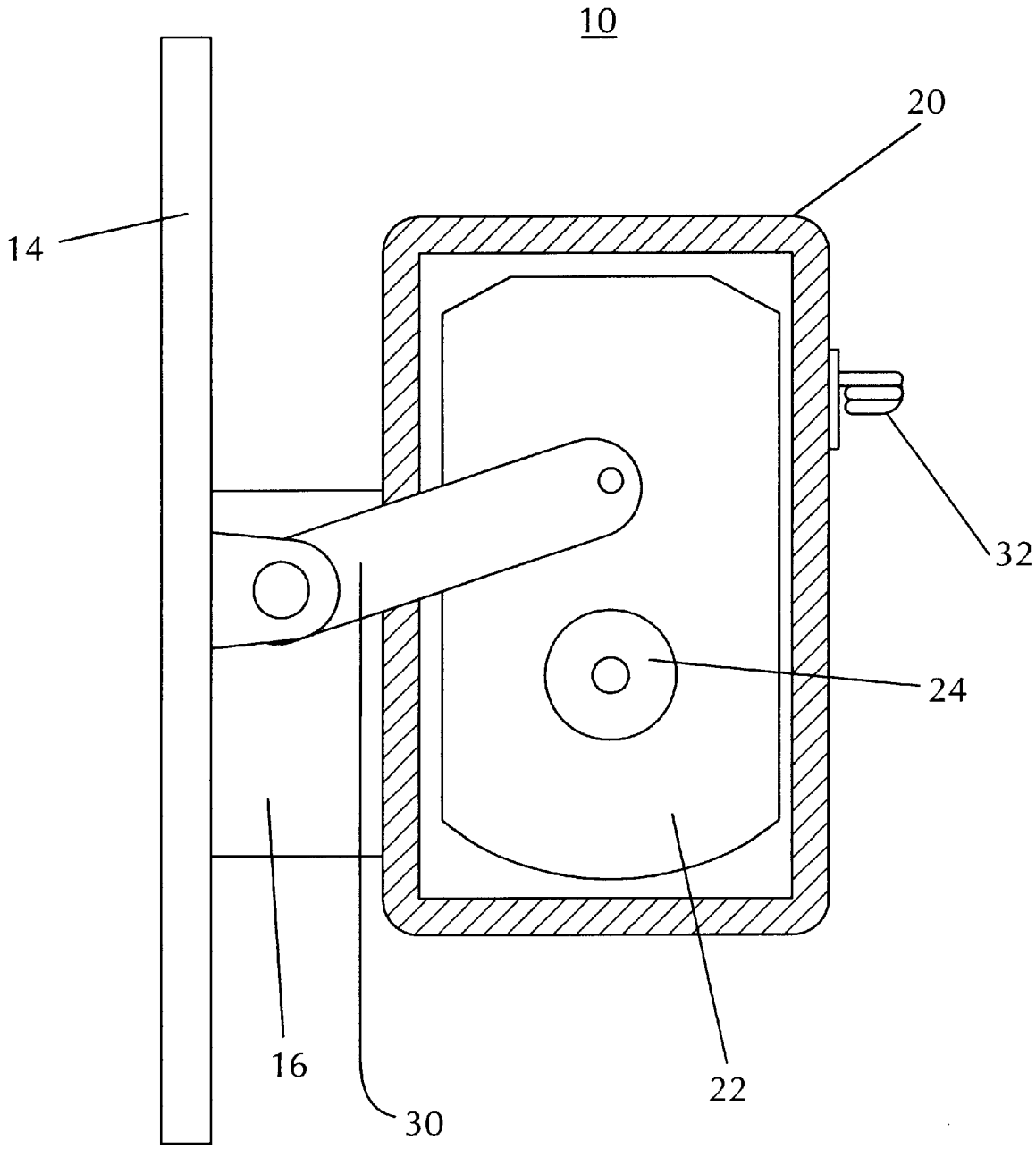
FIG. 4 is a side cut-away view of the flapping heart device.

FIG. 4 is a side cut-away view of the flapping heart device. Again illustrated are the right side of the heart (14), central support member (16), housing (20), wind-up handle (24), right linkage means (30), and pin assembly (32).

As previously noted, right linkage means (30) extends outwardly from power means (22) located within housing (20), with the distal end of right linkage means (30) rigidly attached to the right side of the heart (14). Similarly, though not shown, left linkage means (28) extends outwardly from power means (22) located within housing (20), with the distal end of left linkage means (28) rigidly attached to the left side of the heart (12).

Figure 5:
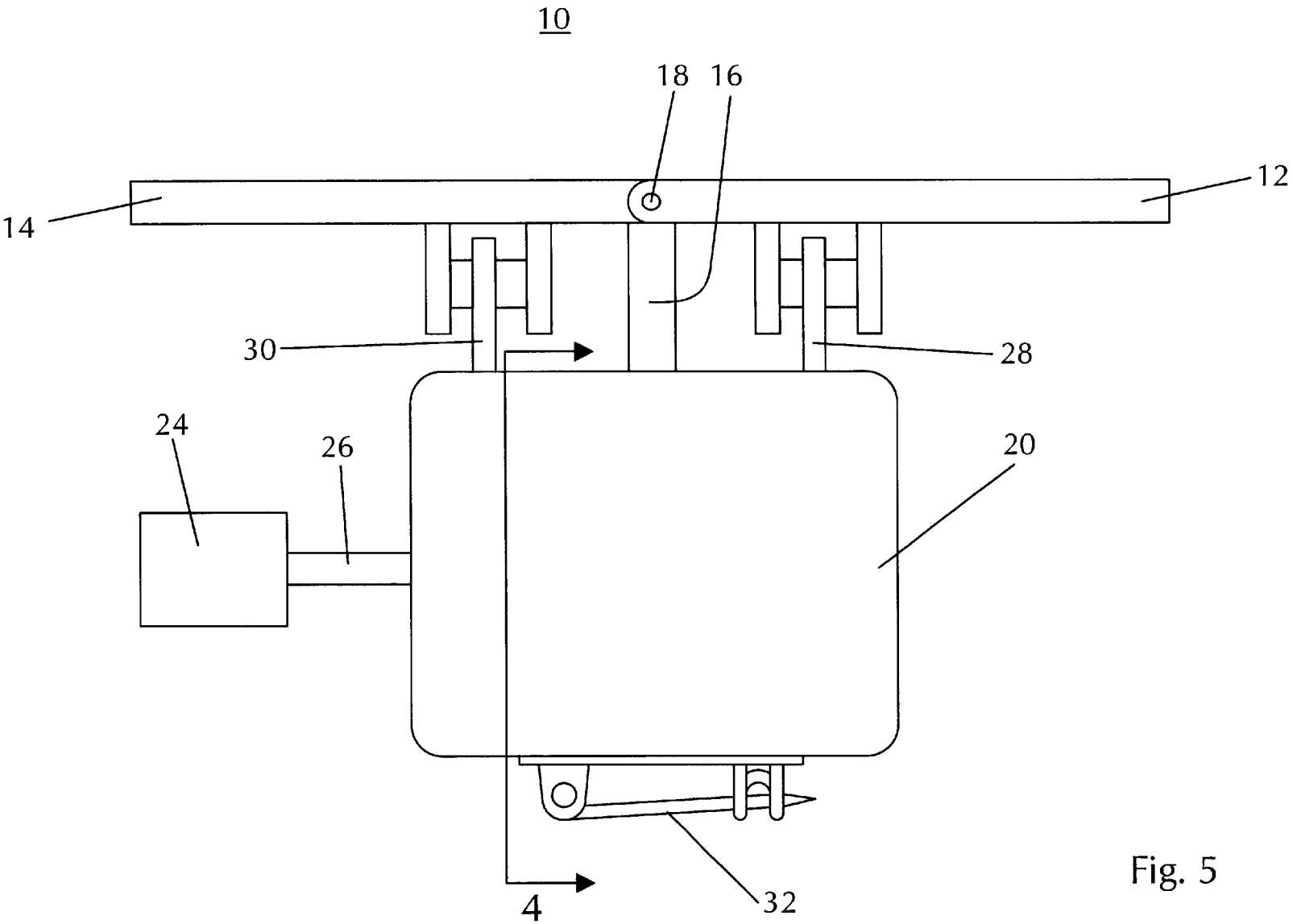
FIG. 5 is a top view of the flapping heart device, illustrating pin attachment means, and line "4" denoting FIG. 4 view.

FIG. 5 is a top view of the flapping heart device, illustrating pin attachment means, and line "4" denoting FIG. 4 view. Specifically, illustrated are the left side of the heart (12), right side of the heart (14), central support member (16), hinge pin (18), housing (20), wind-up handle (24), wind-up shaft (26), left linkage means (28), right linkage means (30), and pin assembly (32).

Hinge pin (18) is aligned vertically, and runs through central support member (16), through openings within the central support member (16). This allows the left side of the heart (12) and right side of the heart (14) to swivel therefrom to create the flapping effect.

FIG. 6 is a top cut-away view of the flapping heart device, illustrating drive means. As in FIG. 5, illustrated are the left side of the heart (12), right side of the heart (14), central support member (16), hinge pin (18), housing (20), power means (22), wind-up handle (24), wind-up shaft (26), left linkage means (28), right linkage means (30), and pin assembly (32). In this FIGURE, left side of the heart (12) and right side of the heart (14) are shown aligned in 180 degree orientation prior to powering of the device and resulting flapping of the halves.

Figure 7:
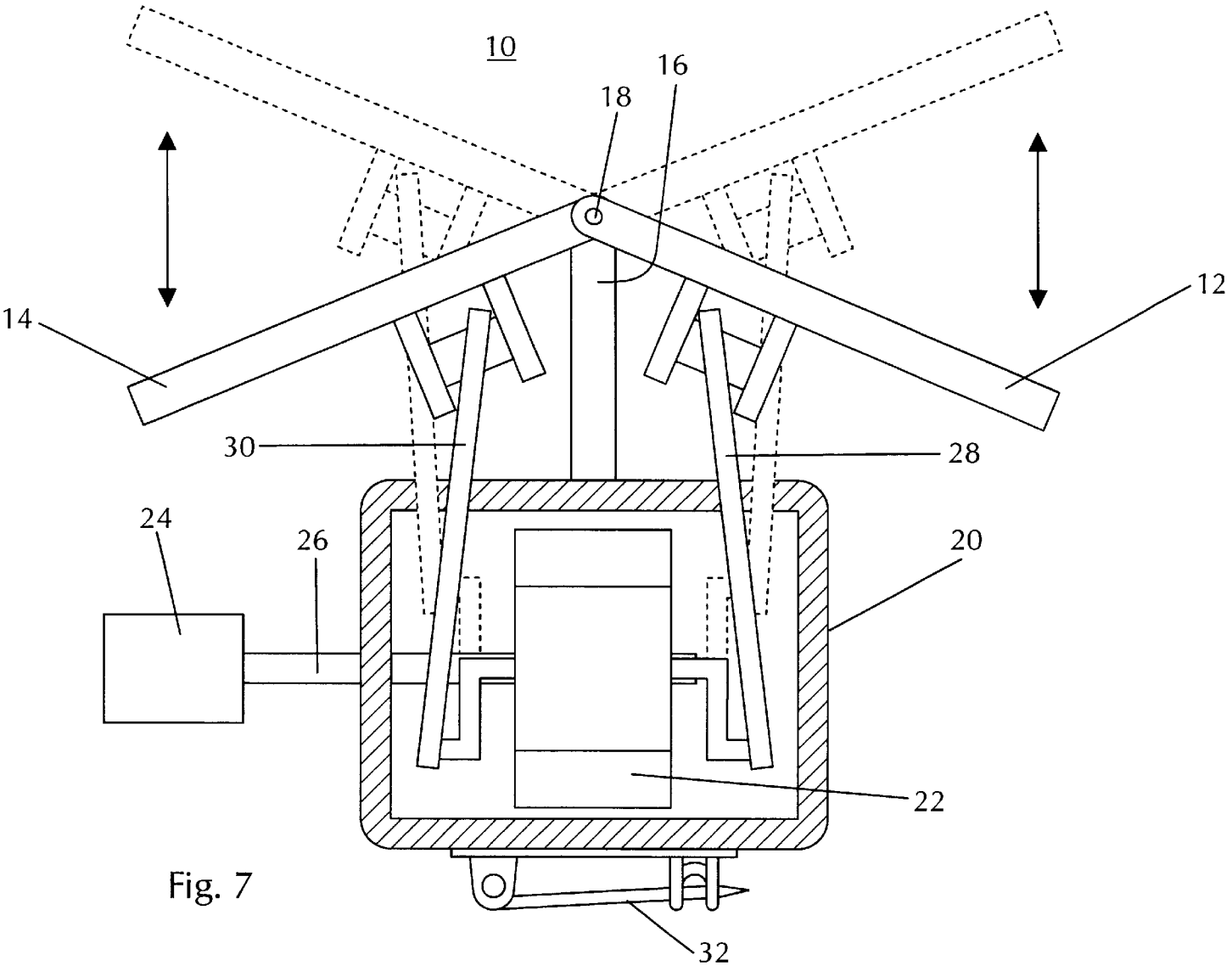
FIG. 7 is a top cut-away view of the flapping heart device, illustrating drive means and direction of motion of left and right sides of the heart.

FIG. 7 is a top cut-away view of the flapping heart device, illustrating drive means and direction of motion of left and right sides of the heart. Illustrated again are the left side of the heart (12), right side of the heart (14), central support member (16), hinge pin (18), housing (20), power means (22), wind-up handle (24), wind-up shaft (26), left linkage means (28), right linkage means (30), and pin assembly (32).

In this FIGURE, the full range of motion of left side (12) and right side (14) is shown, whereby the outer edges of each half first swivel away from the housing, and then swivel towards the housing for the flapping effect. Importantly, a first end of left linkage means (28) and right linkage means (30) are rigidly affixed to a double-ended crank shaft, and positioned perpendicularly thereto, to drive the two halves of the heart back and forth to create the flapping effect.

In general, it should be noted that the speed of the flapping of the present invention may be previously determined, according to both appearance of the item and capability of the power and drive means. In addition, other elements known in the art may be incorporated into the device to enhance its overall entertainment, including but not limited to an audio means and an illumination means.

While the invention has been described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

I claim:

1. A flapping heart amusement device comprising:

a left side of the heart, a right side of the heart, and a central support member, the left side of the heart and right side of the heart symmetrical in nature and representing each half of a heart shape, an interior edge of each side meeting at the central support member, the central support member cylindrical and vertical in orientation;

a vertically aligned hinge pin running through central support member through openings within the central support member, the hinge pin allowing the left side of the heart and the right side of the heart to swivel therefrom;

a housing which encapsulates a power means located at a position behind the left side of the heart and right side of the heart;

a left linkage means extending outwardly from the power means located within the housing and engaging the left side of heart, a first end of left linkage rigidly affixed to a double-ended crank shaft located within the housing and positioned perpendicularly thereto, a distal end of left linkage means rigidly attached to the left side of the heart;

a right linkage means extending outwardly from the power means located within the housing and engaging the right side of heart, a first end of right linkage means rigidly affixed to the double-ended crank shaft located within the housing and positioned perpendicularly thereto, a distal end of right linkage means rigidly attached to the right side of heart, engagement of the power means functioning to rotate the crankshaft along the horizontal axis, functioning to engage the left linkage means and right linkage means, functioning to drive the two sides of the heart forwardly and rearwardly to create a flapping effect.

2. The flapping heart amusement device as described in claim 1, wherein the power means comprises a wind-up gear box comprising a wind-up handle, turning of the wind-up handle rotating a wind-up shaft rigidly affixed thereto to engage the power means.

3. The flapping heart amusement device as described in claim 1, wherein the power means comprises a pull cord.

4. The flapping heart amusement device as described in claim 1, wherein the power means comprises at least one battery.

5. The flapping heart amusement device as described in claim 1, wherein the device bears indicia upon the exterior surface thereof.

6. The flapping heart amusement device as described in claim 1, wherein the device bears text upon the exterior surface thereof.

7. The flapping heart amusement device as described in claim 1, wherein the exterior surface is generally transparent.

8. The flapping heart amusement device as described in claim 1, wherein the exterior surface is generally translucent.

9. The flapping heart amusement device as described in claim 1, wherein the heart-shaped housing is constructed of a durable, lightweight plastic.

10. The flapping heart amusement device as described in claim 9, wherein the device further comprises an illumination means.

11. The flapping heart amusement device as described in claim 9, wherein the device comprises a pin means which functions to allow the device to be removably fastened to another object.

12. The flapping heart amusement device as described in claim 1, wherein the device further comprises an audio means.

13. The flapping heart amusement device as described in claim 1, wherein the device comprises at least one magnet affixed to a rear surface thereof, which functions to allow the device to be removably attached to another object.

14. The flapping heart amusement device as described in claim 1, wherein the device comprises a stand apparatus, which functions to allow the device to be conveniently placed atop a flat surface.

15. The flapping heart amusement device as described in claim 1, wherein the device further comprises a means to regulate the speed at which the left side and right side move forwardly and rearwardly.

* * * * *